United States Patent [19]

Tatsumi et al.

[11] Patent Number: 5,044,425

[45] Date of Patent: Sep. 3, 1991

[54] AIR CONDITIONER HAVING A REFRIGERANT HEATER

[75] Inventors: Mitsuyoshi Tatsumi, Fujinomiya; Haruo Noguchi; Takashi Kobayashi, both of Fuji, all of Japan

[73] Assignee: Kabushiki Kaisha Toshiba, Kawasaki, Japan

[21] Appl. No.: 560,733

[22] Filed: Jul. 31, 1990

[30] Foreign Application Priority Data

Sep. 14, 1989 [JP] Japan ..... 1-239195

[51] Int. Cl.[5] ..... F25B 29/00; F25B 27/00; F25B 13/00

[52] U.S. Cl. ..... 165/29; 62/238.7; 62/160; 62/181; 237/2 B

[58] Field of Search ..... 165/29; 237/2 B; 62/238.6, 238.7, 324.4, 181, 160

[56] References Cited

U.S. PATENT DOCUMENTS 4,441,901 4/1984 Endoh ..... 165/29

*Primary Examiner*—John Ford

*Attorney, Agent, or Firm*—Cushman, Darby & Cushman

[57] ABSTRACT

An air conditioner comprising a heat-pump refrigeration circuit including a compressor, a four-way valve, an outdoor heat exchanger, a pressure reducer, an indoor heat exchanger, connected in this order, a refrigerant heater arranged in the refrigeration circuit, the heating capacity thereof being variable, release control for reducing the heating capacity of the refrigerant heater when a detected temperature Tc exceeds a first set temperature Tsl, mode switch for setting the air conditioner in a hot air blow-off mode in which the indoor fan rotates at a low rate during a heating operation. When the mode switch sets the hot air blow-off mode, the rotation rate of the indoor fan is controlled so that the detected temperature Tc is kept lower than the first set temperature Tsl, thereby preventing release control in the hot air blow-off mode.

3 Claims, 8 Drawing Sheets

AIR CONDITIONER HAVING A REFRIGERANT HEATER

BACKGROUND OF THE INVENTION

1. Field of the Invention

This invention relates to an air conditioner having a refrigerant heater.

2. Description of the Related Art

A conventional heat-pump air conditioner has the drawback that the heating capacity decreases as the outdoor temperature falls. An air conditioner having a refrigerant heater is known, which overcomes the drawback and in which a refrigerant heater such as a gas burner heats the refrigerant and cooperates with a heat pump to perform heating operation.

The air conditioner of the conventional type having a refrigerant heater will be described with reference to FIG. 1. As shown in FIG. 1, the air conditioner has a refrigeration circuit including compressor 1, four-way valve 2, outdoor heat exchanger 3, check valve 4, expansion valve 5, indoor heat exchanger 6, and check valve 7, all connected in this order by pipes. Electromagnetic valve 8 and refrigerant heater 9 are connected by pipes and arranged between the refrigerant suction pipe of compressor 1, on one side, and the node connecting check valve 4 and expansion valve 5, on the other side.

Refrigerant heater 9 has gas burner 10 for heating the refrigerant. Gas burner 10 is connected to the fuel source (not shown) by proportional control valve 11.

Outdoor fan 12 for circulating the outdoor air is arranged near outdoor heat exchanger 3, and indoor fan 13 for circulating the indoor air is arranged near indoor heat exchanger 6.

During cooling operation, compressor 1 is activated while electromagnetic valve 8 is closed. As a result, the refrigerant flows in the direction indicated by the solid-line arrows, outdoor heat exchanger 3 functioning as a condenser, and indoor heat exchanger 6 as an evaporator.

During heating operation, compressor 1 is activated and four-way valve 2 is switched while electromagnetic valve 8 is opened. In addition, refrigerant heater 9 is operated, i.e, gas burner 10 is turned on. As a result, the refrigerant flows in the direction indicated by the broken-line arrows, indoor heat exchanger 6 functioning as a condenser, and refrigerant heater 9 as an evaporator In the air conditioner shown in FIG. 1, temperature Tc in indoor heat exchanger 6 is detected. FIG. 2 shows changes of temperature Tc. When the detected temperature Tc exceeds set temperature Ts1, the opening of proportional control valve 11 is narrowed, thereby reducing the degree of the combustion in gas burner 10. Thus, release control is performed so that refrigerant heater 9 generates less heat, preventing the pressure in the refrigeration circuit on the high pressure side from rising extraordinarily.

An air conditioner is also known, which can be set in a hot air blow-off mode. In the mode, indoor fan 13 rotates at a low rate, and hot air is blown off indoors, thereby increasing the indoor temperature satisfactorily.

If the above-mentioned air conditioner having the release control function is set in the hot air blow-off mode is set, hot air is blown off at first; however, as shown in FIG. 3, the temperature Tc of indoor heat exchanger 6 rises to a set temperature Ts1 instantaneously, and the release control is started. As a result, refrigerant heater 9 generates less heat, and warmth is not provided to the user. In addition, since the release control is executed and canceled alternately, the indoor temperature varies greatly, the user cannot have sufficient warm. Thus, it is difficult to perform a comfortable heating.

SUMMARY OF THE INVENTION

It is accordingly an object of the invention to provide an air conditioner in which unnecessary release control is prevented when it is set in the hot air blow-off mode, so that the user can have sufficient warmth.

To achieve this object, the air conditioner of the present invention comprises: a heat-pump refrigeration circuit including a compressor, a four-way valve, an outdoor heat exchanger, a pressure reducer, an indoor heat exchanger, connected in this order; a refrigerant heater arranged in the refrigeration circuit, the heating capacity thereof being variable; an indoor fan for circulating indoor air through the indoor heat exchanger; temperature detecting means for detecting the temperature Tc in the indoor heat exchanger; heating operation means for causing the air conditioner to perform heating operation, in cooperation with the compressor, the four-way valve, and the refrigerant heater; release control means for reducing the heating capacity of the refrigerant heater when the detected temperature Tc exceeds a first set temperature Ts1; setting means for setting the air conditioner in a hot air blow-off mode in which the indoor fan rotates at a low rate; and rotation rate control means for controlling the rotation rate of the indoor fan so that the detected temperature Tc is lower than the first set temperature Ts1, while the air conditioner is set in the hot air blow-off mode.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An air conditioner having a refrigerant heater according to a first embodiment of the present invention will be described with reference to the accompanying drawings.

Figure 1:
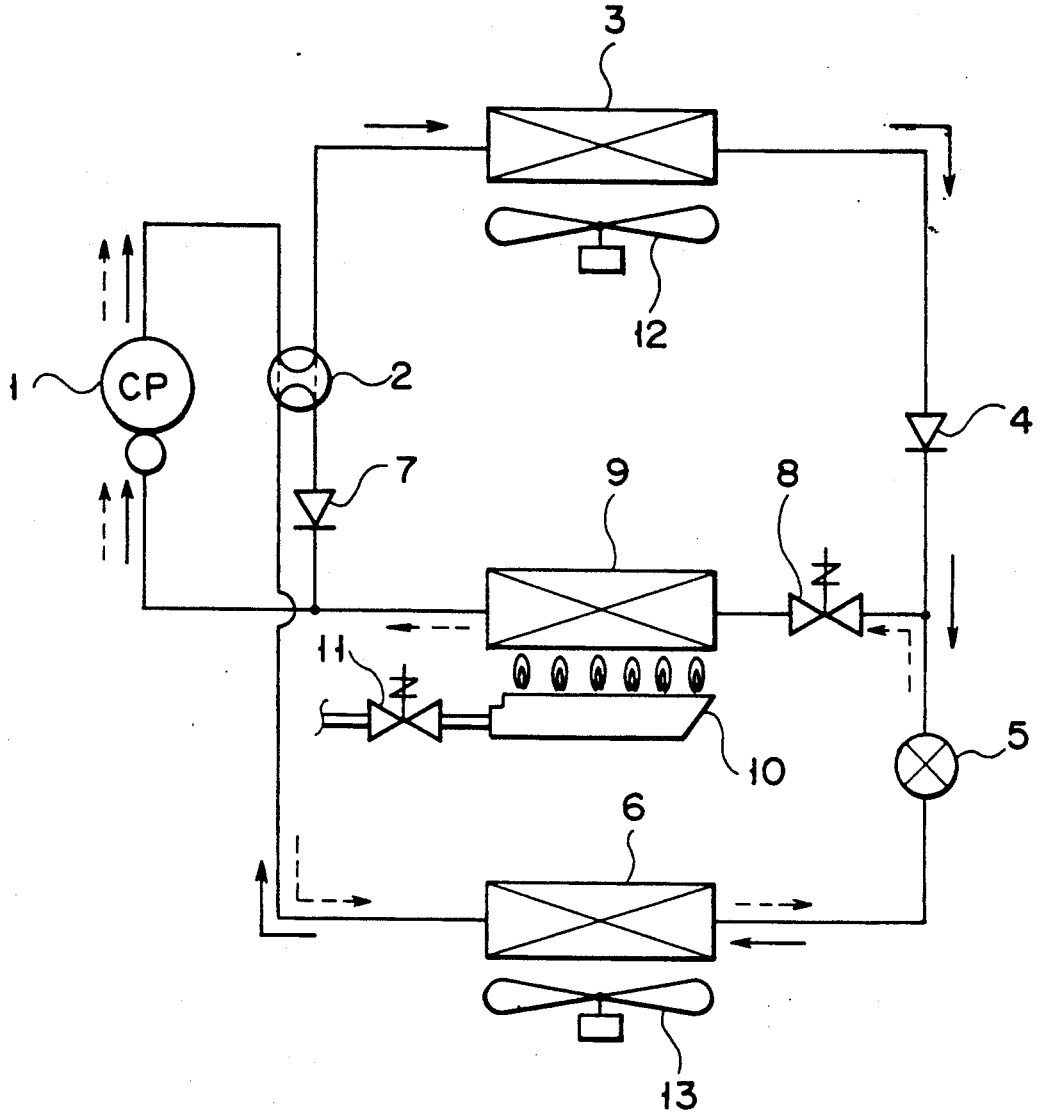
PRIOR ART FIG. 1
FIG. 1 shows the structure of the refrigeration circuit of a conventional air conditioner.
Figure 2:
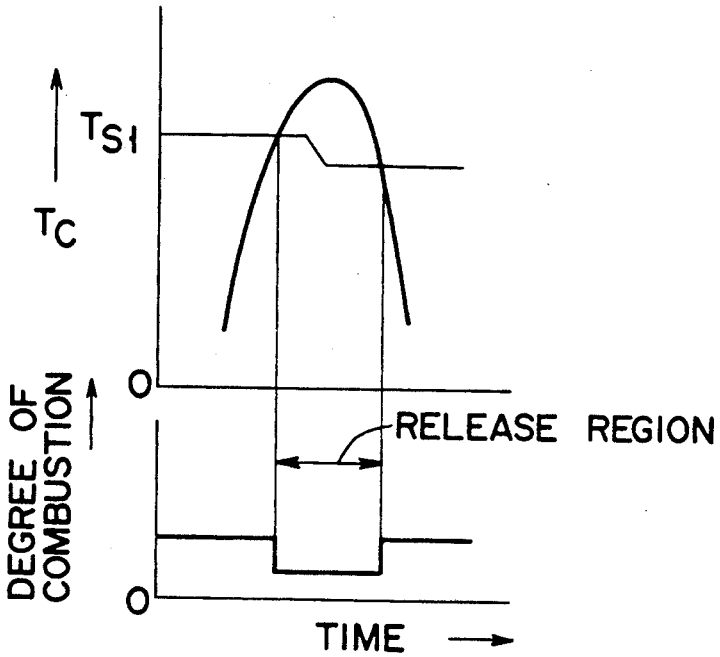
F I G. 2 Prior Art
FIG. 2 is a graph showing operation of a conventional release control means.
Figure 3:
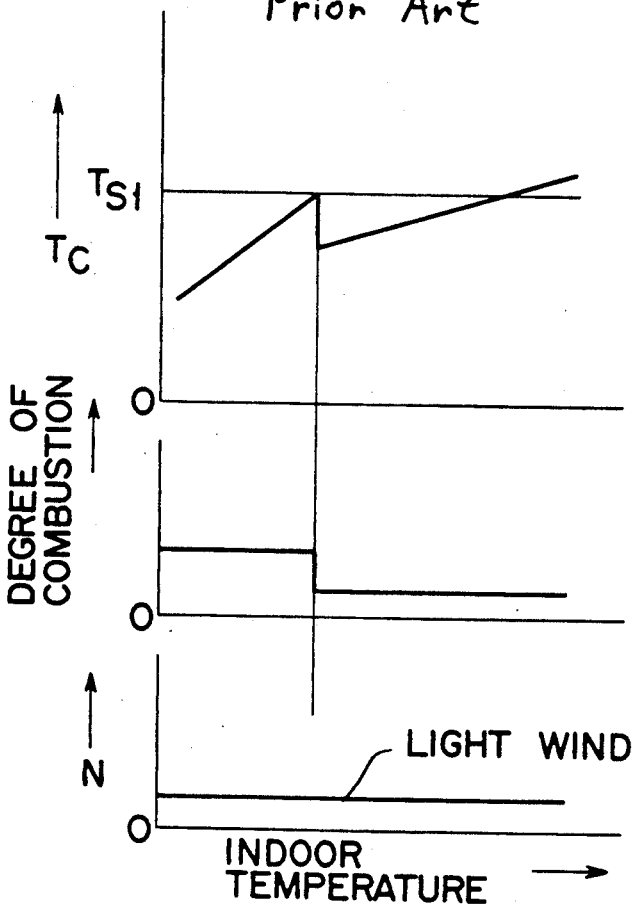
PRIOR ART F I G. 3
FIG. 3 is a graph showing an operation of the conventional air conditioner.
Figure 4:
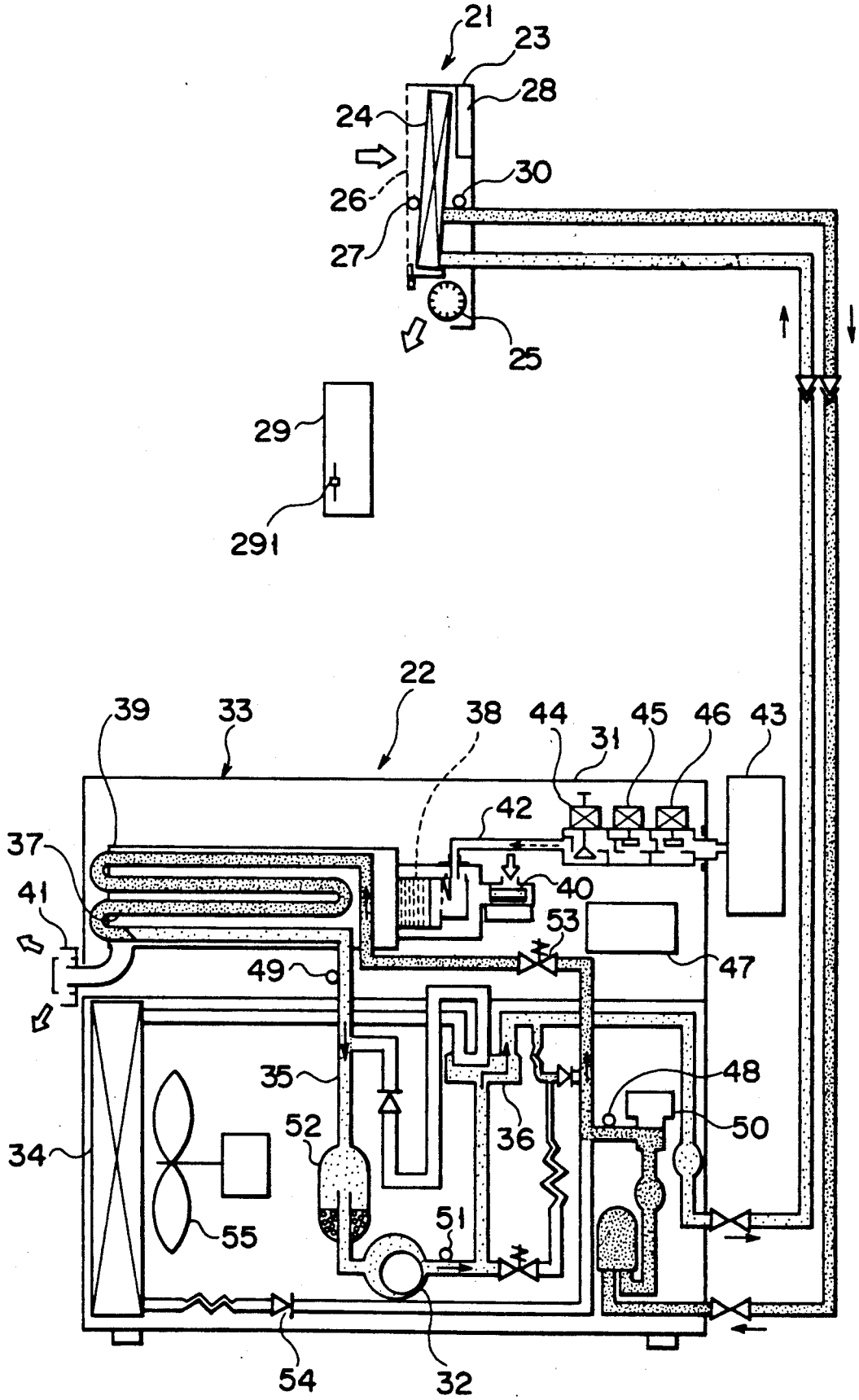
FIG. 4 shows the air conditioner having a refrigerant heater according to a first embodiment of the present invention.

As shown in FIG. 4, the air conditioner is constituted by indoor unit 21 and outdoor unit 22 connected to each other. Indoor unit 21 has case 23, which houses indoor heat exchanger 24 and indoor fan 25. Indoor temperature sensor 27 for detecting the indoor temperature is provided near suction ports 26 of case 23. Indoor control section 28, including a microcomputer and its peripheral circuits, is also housed in case 23. It controls the entire air conditioner in response to commands sent from an operation panel (not shown) or remote controller 29. Remote controller 29 includes mode switch 291 for setting the air conditioner in a hot air blowoff mode.

Indoor heat exchanger temperature sensor 30 is provided near indoor heat exchanger 24. It detects the temperature of the refrigerant flowing from or into heat exchanger 24. In accordance with the temperature of the refrigerant detected by sensor 30, the flow rate of air which indoor fan 25 allows to flow is controlled, the pressure on the high pressure side is prevented from rising extraordinarily during the heating operation, and heat exchanger 24 is prevented from freezing.

Outdoor unit 22 has housing 31, in which compressor 32, refrigerant heater 33, and outdoor heat exchanger 34 are arranged. Outdoor heat exchanger 34 is used only during cooling operation of the air conditioner. Compressor 32, refrigerant heater 33, outdoor heat exchanger 34, and indoor heat exchanger 24 are connected by refrigerant tube 35, constituting a refrigerant circuit.

Heat exchangers 24 and 34, and heater 33 are connected in parallel to compressor 32 by four-way valve 36. During heating operation, the refrigerant is discharged from compressor 32 and flows through four-way valve 36, indoor heat exchanger 24, and refrigerant heater 33. During cooling operation, the refrigerant is discharged from compressor 32 and flows through four-way valve 36, outdoor heat exchanger 34, and indoor heat exchanger 24

Refrigerant heater 33 includes heat exchanger section 37, in which the refrigerant flows, connected to refrigerant tube 35. Gas burner 38 and guide duct 39 for guiding combustion gas generated by the combustion of gas burner 38, constitute a combustion chamber. Heat exchanger section 37 is arranged in guide duct 39. The refrigerant flowing through heat exchanger section 37 is heated by the combustion gas flowing through guide duct 39. Combustion fan 40 for supplying air necessary for combustion to gas burner 38 is arranged near the entrance of gas burner 38. Exhaust top 41 is provided on the exit of guide duct 39.

Gas burner 38 is connected by gas supplying tube 42 to fuel gas source 43. In the middle portion of gas supplying tube 42, gas proportional control valve 44 and a pair of electromagnetic valves 45 and 46 are provided for controlling the amount of gas supplied to gas burner 38. These valves 44 to 46 are controlled by controller 47 arranged in housing 31.

Outdoor unit 22 also has entrance heat sensor 48 for detecting the temperature of the refrigerant flowing into refrigerant heater 33, and exit heat sensor 49 for detecting the temperature of the refrigerant discharged from refrigerant heater 33. On the basis of the difference between the temperatures detected by entrance heat sensor 48 and exit heat sensor 49, expansion valve 50 is controlled. In addition, discharge sensor 51 is provided near the discharging port of compressor 32 and detects the temperature of the refrigerant discharged form compressor 32. If the temperature detected by discharge sensor 51 is equal to a set value or higher, the refrigeration circuit is turned off.

Accumulator 52 is interposed in refrigerant tube 35, between the suction port of compressor 32 and refrigerant heater 33.

Out door unit 22 further includes electromagnetic valve 53, check valve 54, and outdoor fan 55.

Figure 5:
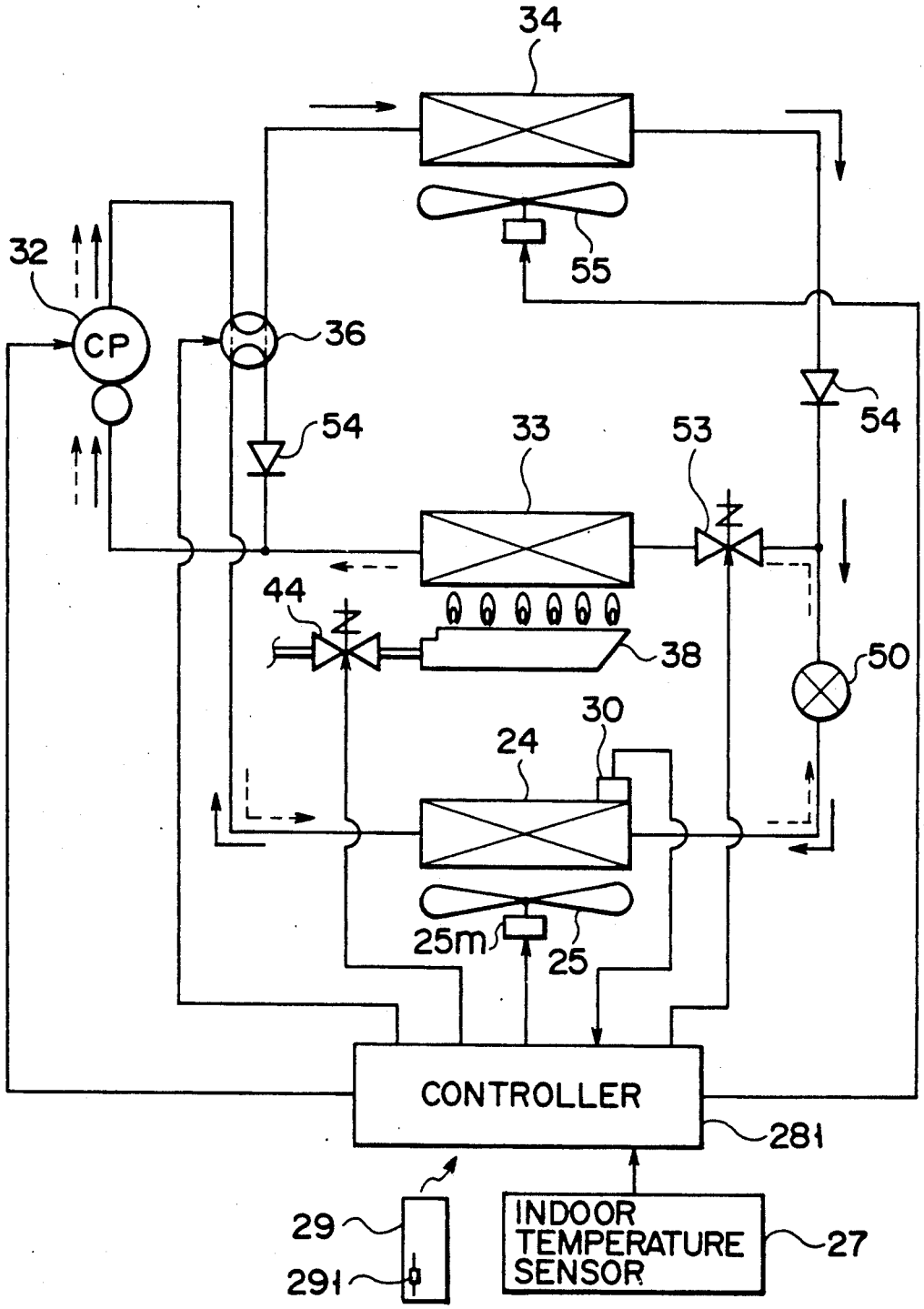
FIG. 5 shows the structure of the refrigeration circuit and the control circuit of the first embodiment.

FIG. 5 shows the refrigeration circuit and the control circuit of the air conditioner shown in FIG. 4. In FIG. 5, to make the explanations simple, indoor control section 28 and controller 47 shown in FIG. 4 are substituted by controller 281. Indoor fan 25 is rotated by motor 25*m*, the rotation rate of which is continuously controlled by controller 281.

An operation of the first embodiment as mentioned above will now be described. When cooling operation is started in response to the command from remote controller 29, controller 281 activates compressor 32 and causes electromagnetic valve 53 to close. As a result, the refrigerant flows in the direction indicated by the solid-line arrows in FIG. 5, thereby forming a cooling circuit. In other words, outdoor heat exchanger 35 functions as a condenser, and indoor heat exchanger 24 as an evaporator, thus operating indoor fan 25 so that cold air is blown off in the room.

In contrast, when heating operation is started in response to the command from remote controller 29, controller 281 activates compressor 32 and causes electromagnetic valve 53 to open. In addition, four-way valve 36 is operated and refrigerant heater 33 is driven, i.e., gas burner 38 is turned on. As a result, the refrigerant flows in the direction indicated by the broken-line arrows in FIG. 5, thereby forming a heating circuit. In other words, indoor heat exchanger 24 functions as a condenser, and refrigerant heater 33 as an evaporator, thus operating indoor fan so that hot air is blown off in the room.

Figure 6:
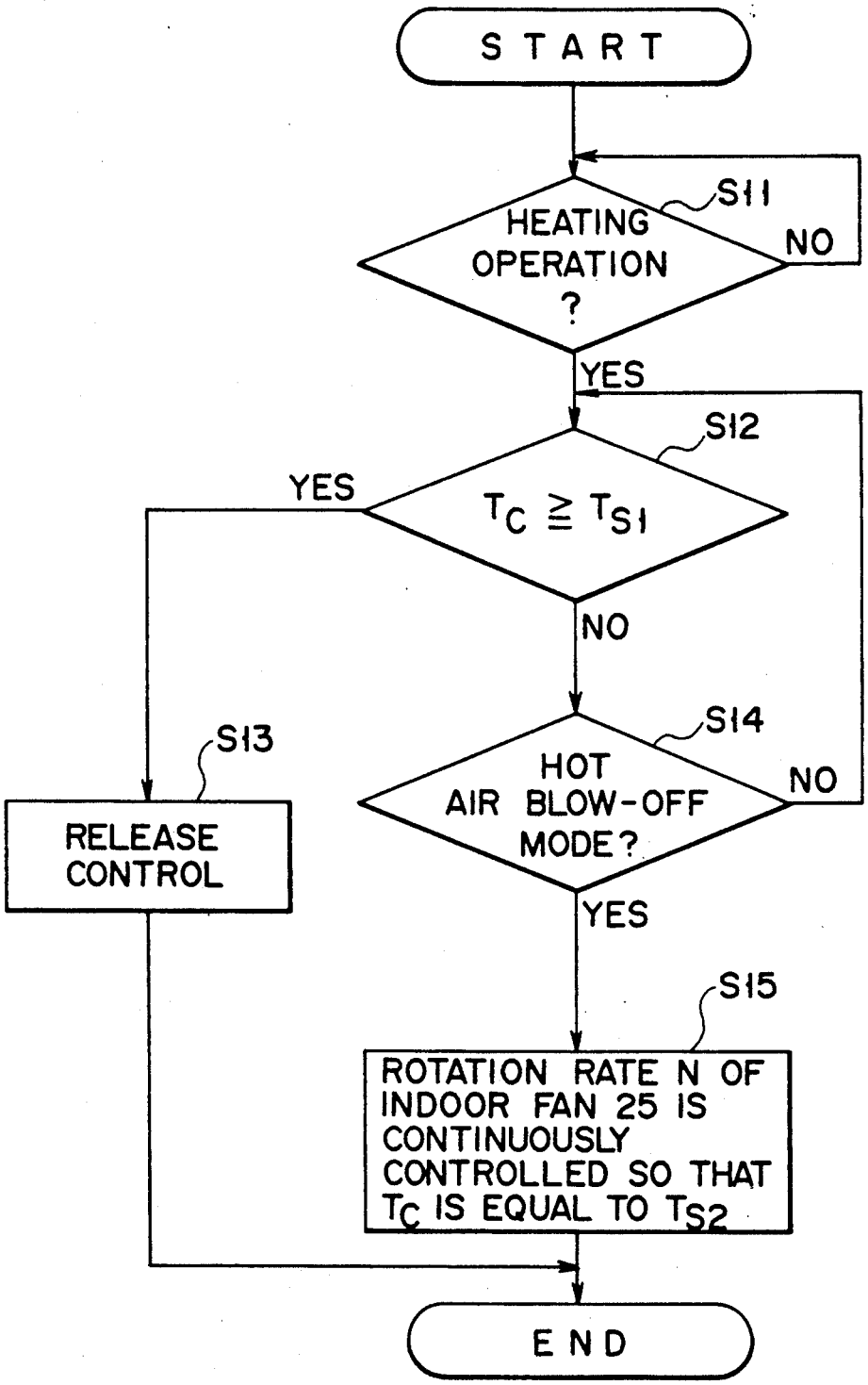
FIG. 6 is a flow chart showing operation of the air conditioner according to the first embodiment.

In the heating operation, controller 281 executes processes shown in the flow chart of FIG. 6. First, it is determined whether a heating operation is performed (step S11). If it is determined that heating operation is performed, the temperature Tc detected by indoor heat exchanger temperature sensor 30 is compared with a first set temperature Ts1 (step S12). If "$Tc \geqq Ts1$" is determined in step S12, the amount of fuel supplied to gas burner 38 is reduced by narrowing down the opening of gas proportional valve 44, i.e., the heater 33 generates less heat. As a result, the pressure on the high pressure side of compressor 32 is prevented from extremely rising.

If "$Tc < Ts1$" is determined in step 12, control section 28 determines whether the hot air blow-off mode is set by mode switch 291 of remote controller 29 (step S14). If it is determined that the hot air blow-off mode is set in step 14, the rotation rate N of indoor fan 25 is continuously controlled so that the detected temperature Tc is equal to a second set temperature Ts2 (Ts2<Ts1) (step S15).

Figure 7:
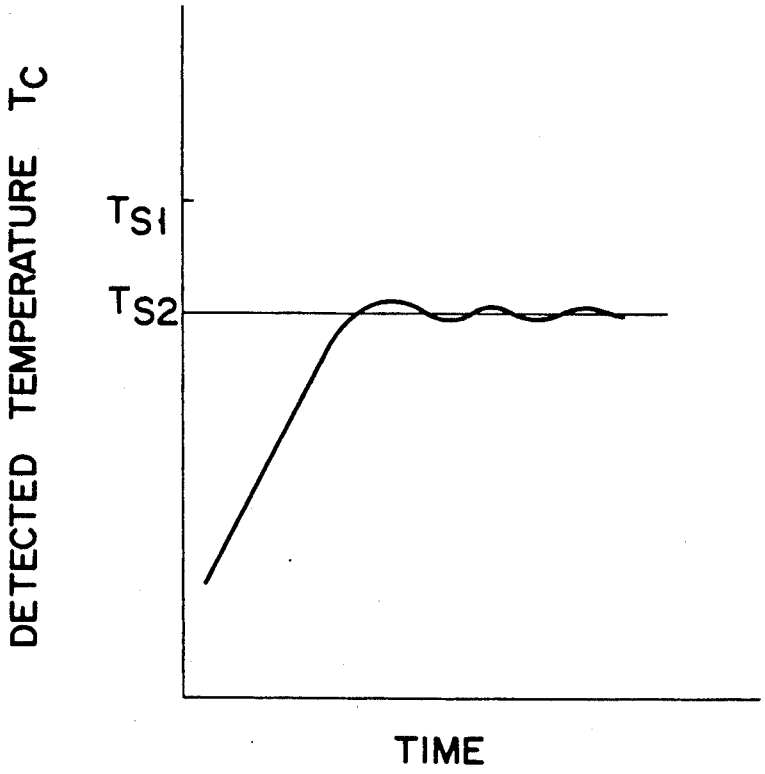
FIG. 7 is a graph showing changes of the temperature in the indoor heat exchanger according to the first embodiment.

Thus, when the hot air blow-off mode is set by remote controller 29, the rotation rate N of indoor fan 25 is continuously controlled by, e.g. the PID action (proportional plus integral plus derivative action), so that the detected temperature Tc approaches the second set temperature Ts2. By virtue of this control, the detected temperature Tc is kept around the second set temperature Ts2, as shown in FIG. 7. Thus, since the detected temperature Tc is prevented from increasing above the set temperature Ts1, release control is performed only if absolutely necessary. Moreover, since the execution and cancellation of the release control are not repeated, change in the indoor temperature is kept small, thereby enabling comfortable heating.

Figure 8:
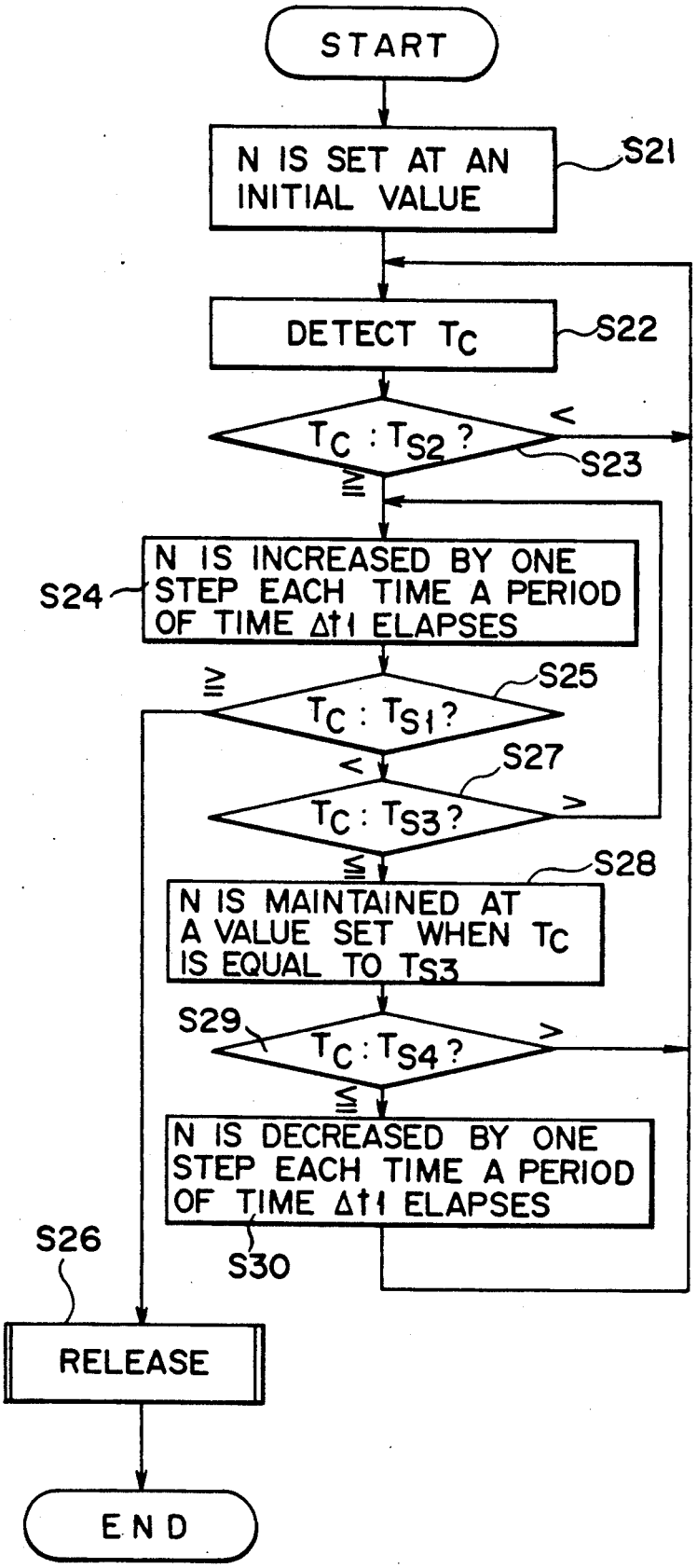
FIG. 8 is a flow chart showing operation of the air conditioner of a second embodiment.

A second embodiment of the present invention will be described below with reference to FIGS. 8 and 9. The second embodiment has the same structure as that of the first embodiment, except that the rotation rate of motor 25*m* for driving indoor fan 25 is controlled step by step, by means of controller 281. Hence, descriptions of the structure will be omitted here.

An operation of the second embodiment will now be described. In heating operation, when the air conditioner is set in the hot air blow-off mode by remote controller 29, indoor fan 25 rotates at the low rate initially set (step S21). As a result, hot air is blown off in the room. Then, the temperature Tc detected by indoor heat exchanger temperature sensor 30 is compared with a second set temperature Ts2 (steps S22, S23). First to fourth set temperatures Ts1 to Ts4 has the relationship Ts1>Ts2>Ts3>Ts4, as shown in FIG. 9. While "Tc<Ts2" is determined in step S23, process of steps S22 and S23 are repeated.

Figure 9:
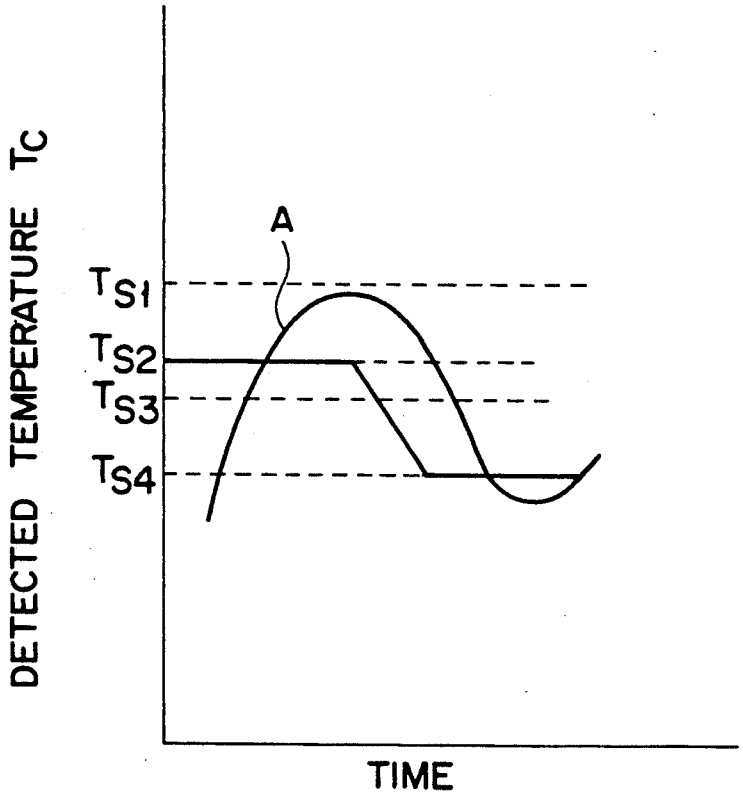
FIG. 9 is a graph showing changes of the temperature in the indoor heat exchanger according to the second embodiment.

As the detected temperature Tc gradually increases as indicated by curve A in FIG. 9, and exceeds the second set temperature Ts2, the controller determines "Tc≧Ts2" in step S23, and the rotation rate N of motor 25*m* for driving indoor fan 25 is increased by a predetermined rate ΔN each time a predetermined period of time Δt1 elapses (step S24). Then, the detected temperature Tc is compared with the first set temperature Ts1 (step S25). If "Ts≧Ts1" is determined in step S25, the opening of gas proportional valve 44 is narrowed down, thus executing release control in which refrigerant heater 33 generates less heat (step S26). If "Tc<Ts1" is determined in step S25, the detected temperature Tc is compared with the third set temperature Ts3 (step S27). If "Tc>Ts3" is determined in step S27, the process returns to step S24 and the subsequent process is repeated. Thus, When the detected temperature is equal to or higher than the second set temperature Ts2, the control subsequent to step S24 is continued unless the detected temperature decreases to the third set temperature Ts3 or lower.

As the detected temperature decreases by the release control, if "Tc≧Ts3" is determined in step S27, the rotation rate N of motor 25*m* for driving indoor fan 25 is maintained at a value set when the detected temperature Tc is equal to the third set temperature Ts3 (step S28).

Then, the detected temperature Tc is compared with the fourth set temperature Ts4 (step S29). If "Tc≧Ts4" is determined in step S29, the rotation rate N of motor 25*m* is decreased by a predetermined rate ΔN each time a predetermined period of time Δt2 elapses (step S30). Thereafter, the processes of step S22 and the subsequent steps are repeated.

If "Tc>Ts4" is determined in step S29, the process returns to step S22. Thus, the processes of step 22 and the subsequent steps are performed after the detected temperature Tc decreases to the third set temperature Ts3 or lower. If the detected temperature is equal to the second set temperature Ts2 or higher, the rotation rate N of motor 25*m* is increased by ΔN each time when a predetermined period of time Δt1 elapses (step S24).

As described above, in the second embodiment, when the detected temperature Tc rises to the second set temperature Ts2 or higher, the rotation rate N of motor 25*m* is increased. However, the rotation rate N does not decrease immediately after the detected temperature T becomes lower than the second set temperature Ts2. It decreases when the detected temperature becomes lower than the fourth set temperature Ts4.

In the second embodiment also, as in the first embodiment, since the detected temperature Tc is prevented from rising above the set temperature Ts1, release control is performed only if absolutely necessary. Moreover, since the execution and cancellation of the release control are not repeated, change in the indoor temperature is kept small, thereby enabling comfortable heating.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An air conditioner comprising:

a heat-pump refrigeration circuit including a compressor, a four-way valve, an outdoor heat exchanger, a pressure reducer, an in door heat exchanger, connected in this order;

a refrigerant heater arranged in the refrigeration circuit, the heating capacity thereof being variable;

an indoor fan for circulating indoor air through the indoor heat exchanger;

temperature detecting means for detecting a temperature Tc in the indoor heat exchanger;

heating operation means for causing said heat-pump refrigeration circuit to perform a heating operation, in cooperation with the compressor, the four-way valve, and the refrigerant heater;

release control means for reducing the heating capacity of the refrigerant heater, when the detected temperature Tc exceeds a first set temperature Ts1;

setting means for causing the air conditioner to operate in a hot air blow-off mode in which the indoor fan rotates at a low rate; and rotation rate control means for continuously controlling the rotation rate of the indoor fan so that the detected temperature Tc is kept at a second set temperature Ts2 which is lower than the first set temperature Ts1, while the air conditioner is set in the hot air blow-off mode.

2. An air conditioner comprising:

a heat-pump refrigeration circuit including a compressor, a four-way valve, an outdoor heat exchanger, a pressure reducer, an indoor heat exchanger, connected in this order;

a refrigerant heater arranged in the refrigeration circuit, the heating capacity thereof being variable;

an indoor fan for circulating indoor air through the indoor heat exchanger;

temperature detecting means for detecting the temperature Tc in the indoor heat exchanger;

heating operation means for causing said heat-pump refrigeration circuit to perform a heating operation, in cooperation with the compressor, the four-way valve, and the refrigerant heater;

release control means for reducing the heating capacity of the refrigerant heater, when the detected temperature Tc exceeds a first set temperature Ts1;

setting means for causing the air.conditioner to operate in a hot air blow-off mode in which the indoor fan rotates at a low rate; and rotation rate control means for continuously controlling the rotation rate of the indoor fan so that the detected temperature Tc is kept lower than the first set temperature Ts1, while the air condition is set in the hot air blow-off mode, said rotation rate control means increasing the rotation rate of said indoor fan by a predetermined rate each time a first predetermined period of time elapses, when the detected temperature is equal to or higher than a second set temperature Ts2, which is lower than Ts1, and it decreases the rotation rate of said indoor fan by a predetermined rate each time a second predetermined period of time elapses, when the detected temperature is equal to or lower than a fourth set temperature which is lower than the second set temperature Ts2.

3. An air conditioner comprising:

a heat-pump refrigeration circuit including a compressor, a four-way valve, an outdoor heat exchanger, a pressure reducer, an indoor heat exchanger, connected in this order;

a refrigerant heater arranged in the refrigeration circuit, the heating capacity thereof being variable;

an indoor fan for circulating indoor air through the indoor heat exchanger;

temperature detecting means for detecting the temperature Tc in the indoor heat exchanger;

heating operation means for causing said heat-pump refrigeration circuit to perform a heating operation, in cooperation with the compressor, the four-way valve, and the refrigerant heater;

release control means for reducing the heating capacity of the refrigerant heater, when the detected temperature Tc exceeds a first set temperature Ts1;

setting means for causing the air conditioner to operate in a hot air blow-off mode in which the indoor fan rotates at a low rate; and rotation rate control means for continuously controlling the rotation rate of the indoor fan so that the detected temperature Tc is kept lower than the first set temperature Ts1, while the air conditioner is set in the hot air blow-off mode, said rotation rate control means increasing the rotation rate of said indoor fan by a predetermined rate each time a first predetermined period of time elapses, when the detected temperature is equal to or higher than the second set temperature Ts2, which is lower than Ts1, and it decreases the rotation rate of said indoor fan by a predetermined rate each time a second predetermined period of time elapses, when the detected temperature is equal to or lower than a fourth set temperature which is lower than the second set temperature Ts2, said rotation rate control means maintaining the rotation rate of said indoor fan, when the detected temperature is equal to a third set temperature which is lower than the second set temperature and higher than the fourth set temperature.

* * * * *